US007661167B2

(12) United States Patent
Wu

(10) Patent No.: US 7,661,167 B2
(45) Date of Patent: Feb. 16, 2010

(54) POSITIONING MEMBER FOR SECURING MOVABLE JAW OF ADJUSTABLE WRENCH DURING SURFACE GRINDING PROCESS

(75) Inventor: Arthur Wu, Taichung County (TW)

(73) Assignee: Proxene Tools Co., Ltd., Taichung County (TW)

( * ) Notice: Subject to any disclaimer, the term of this patent is extended or adjusted under 35 U.S.C. 154(b) by 0 days.

(21) Appl. No.: 11/785,933

(22) Filed: Apr. 23, 2007

(65) Prior Publication Data

US 2008/0257121 A1 Oct. 23, 2008

(51) Int. Cl.
*B25F 1/00* (2006.01)

(52) U.S. Cl. ..... 7/139; 81/155; 451/104; 451/113

(58) Field of Classification Search ..... 7/139; 81/155, 165, 170, 462; 451/28, 29, 36, 104, 451/113

See application file for complete search history.

(56) References Cited

U.S. PATENT DOCUMENTS

| | | | | | |
|---|---|---|---|---|---|
| 4,333,366 | A * | 6/1982 | Hurtig | 81/170 |
| 5,152,199 | A * | 10/1992 | Lain | 81/177.2 |
| 5,222,419 | A * | 6/1993 | Spector | 81/165 |
| 5,873,770 | A * | 2/1999 | Hashimoto | 451/32 |
| 6,382,056 | B1 * | 5/2002 | Wu | 81/165 |
| 6,477,759 | B2 * | 11/2002 | Hu | 29/527.2 |
| 2008/0282849 | A1 * | 11/2008 | Wu | 81/165 |

* cited by examiner

*Primary Examiner*—Timothy V Eley
(74) *Attorney, Agent, or Firm*—Banger Shia

(57) ABSTRACT

A positioning member is used to position the movable jaw to the sliding groove of the adjustable wrench and the adjustable wrench together with the positioning member are applied by vibrate grinding technology so as to make the outer surface of the movable jaw to be a mirror surface and the rod of the movable jaw is kept as the surface condition after being machine. The tolerance between the rod and the sliding groove is controlled within expected range.

11 Claims, 6 Drawing Sheets

POSITIONING MEMBER FOR SECURING MOVABLE JAW OF ADJUSTABLE WRENCH DURING SURFACE GRINDING PROCESS

BACKGROUND OF THE INVENTION (1) Field of the Invention

The present invention relates to a surface grinding process or obtaining a polished surface of an adjustable wrench and a positioning member for securing the movable jaw of the adjustable wrench during the surface grinding process.

(2) Description of the Prior Art

An adjustable wrench includes a fixed jaw which is integrally connected with the handle of the adjustable wrench, and a movable jaw which is slidably connected to the head of the wrench so that a distance between the fixed 1 and movable jaws can be adjusted. The surface of the adjustable wrench is ground to obtain a smooth surface which is then electroplated with a surface layer to be a mirror surface. The conventional surface grinding process uses a wire to tie the head and the movable jaw together and then the head and the movable jaw are put in a lining barrel in which abrasive chips and compounds are received. The lining barrel is connected with a vibrate motor such that the head and the movable jaw are ground by contact with the abrasive chips and compounds.

As shown in FIG. 9, the surface grinding process grinds the handle 90, the head 91, the fixed jaw 92 and the movable jaw 93. Furthermore, the rod 931 of the movable jaw 93 and a neck 932 connecting the rod 931 and the movable jaw 93, and the surface 933 connecting the surface 932 of the neck 932 and the movable jaw 93, the sliding groove 911 and the surfaces of the walls defining the sliding groove 911 are also be ground. This grinding process removes the surface material of the areas that are ground so that the tolerance becomes larger than expected. The movable jaw 93 shakes in the sliding groove 911 during use and cannot abut a workpiece tightly.

The present invention intends to provide a surface grinding process and a positioning member which is used to position the movable jaw and cover some areas that are not to be ground so that only pre-set areas of the adjustable wrench are ground.

SUMMARY OF THE INVENTION

The present invention relates to an adjustable wrench which includes a handle and a head is fixed to an end of the handle. The fixed jaw integrally extends from a side of the head and a sliding groove is defined in the other side of the head. Two sidewalls extend from the head and define a recess therebetween which communicates with the sliding groove. A through hole is defined through the head and communicates with the sliding groove. The movable jaw is slidably engaged with the sliding groove and includes a jaw and a rod with a neck connected between the jaw and the rod. The positioning member is engaged with the sliding groove to directly or indirectly position the movable jaw with the sliding groove. The adjustable wrench and the positioning member are applied by vibration grinding technology. The rod, the sliding groove, the neck and the two respective top surfaces of the sidewalls are kept unground such that the tolerance between the movable jaw in the sliding groove can be controlled.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENTS

Figure 1:
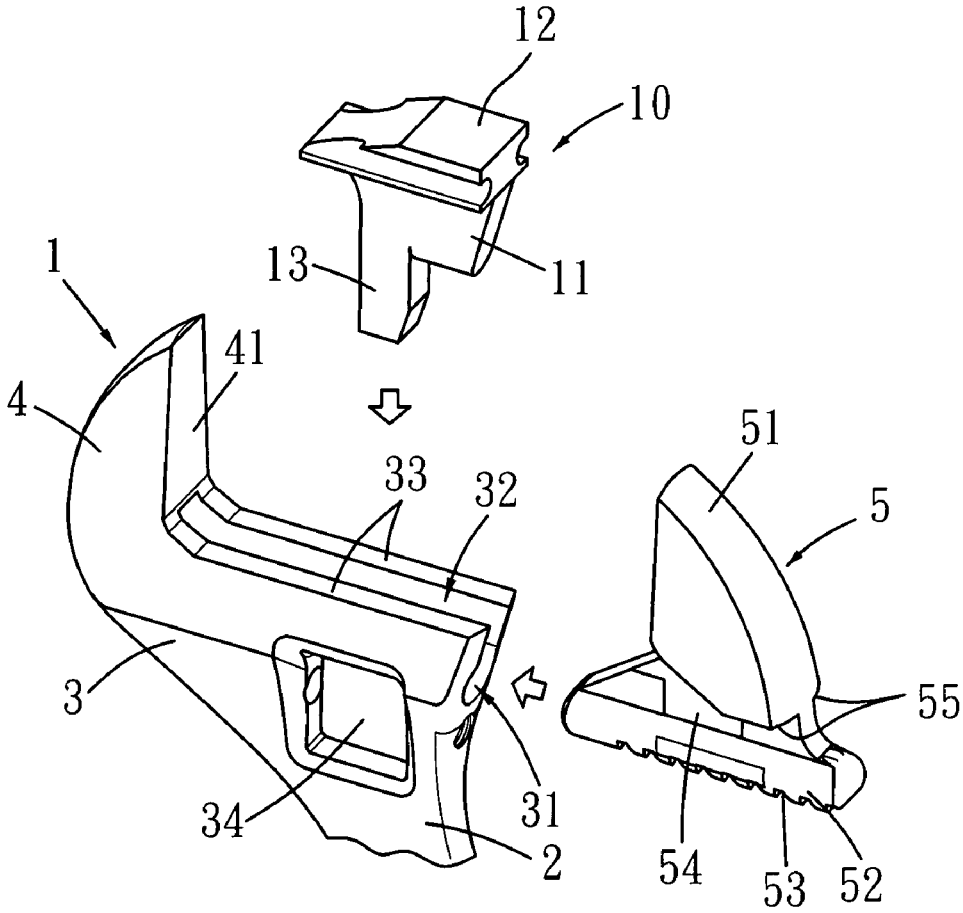
FIG. 1 is an exploded view to show the adjustable wrench and the positioning of the present invention.
Figure 2:
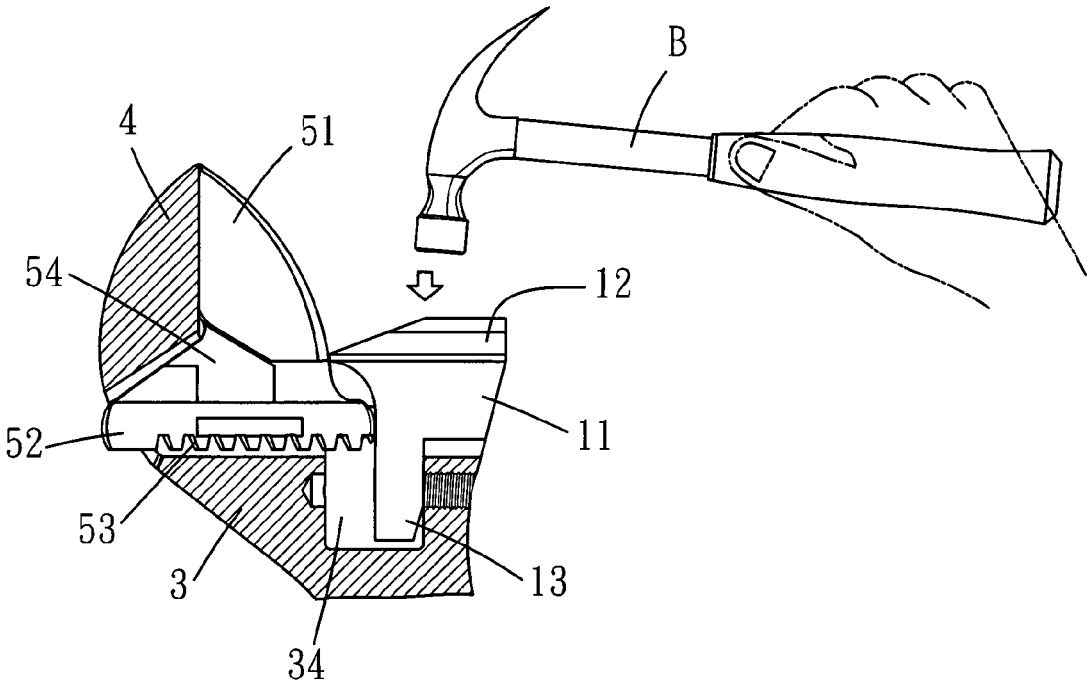
FIG. 2 is a cross sectional view to show that the positioning member is hammered into the recess and the through hole in the head of the adjustable wrench.
Figure 3:
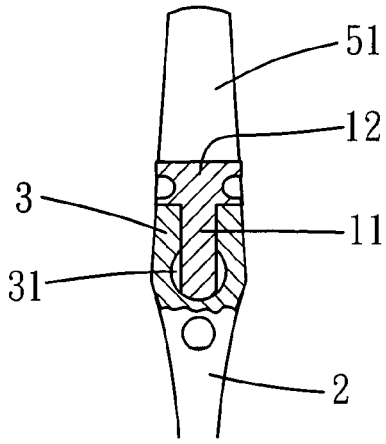
FIG. 3 is an end cross sectional view to show the positioning member is connected to the head of the adjustable wrench.
Figure 4:
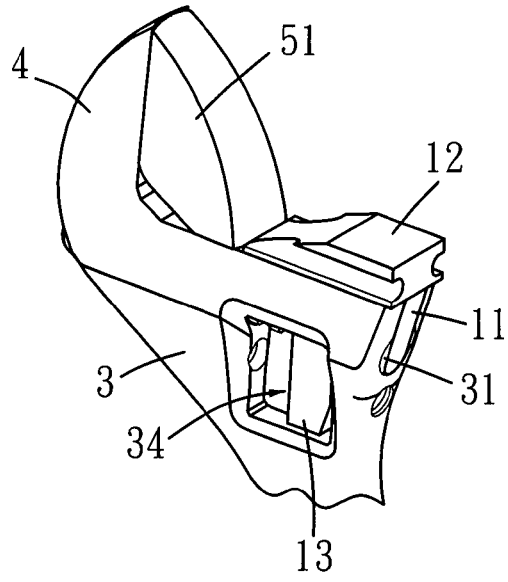
FIG. 4 is a perspective view to show that the positioning member is positioned and the movable jaw is positioned by the positioning member.

Referring to FIGS. 1-4 and 8, the adjustable wrench 1 includes a handle 2 with a head 3 on one end of the handle 2, and a fixed jaw 4 is integrally connected to a top of one side of the head 3 and has a clamping surface 41. A sliding groove 31 is defined in a side of the head 3 and located between two sidewalls 33. A through hole 34 is defined through the head 3 and communicates with the sliding groove 31. A movable jaw 5 includes a rod 52 and a jaw 51, a neck 54 is connected between the jaw 51 and the rod 52 which includes teeth 53 defined in an outer periphery thereof. The rod 52 is slidably inserted into the sliding groove 31 and the teeth 53 are engaged with a driving member (not shown) in the through hole 34. When rotating the driving member, the movable jaw 5 is moved toward or away from the fixed jaw 4.

Figure 8:
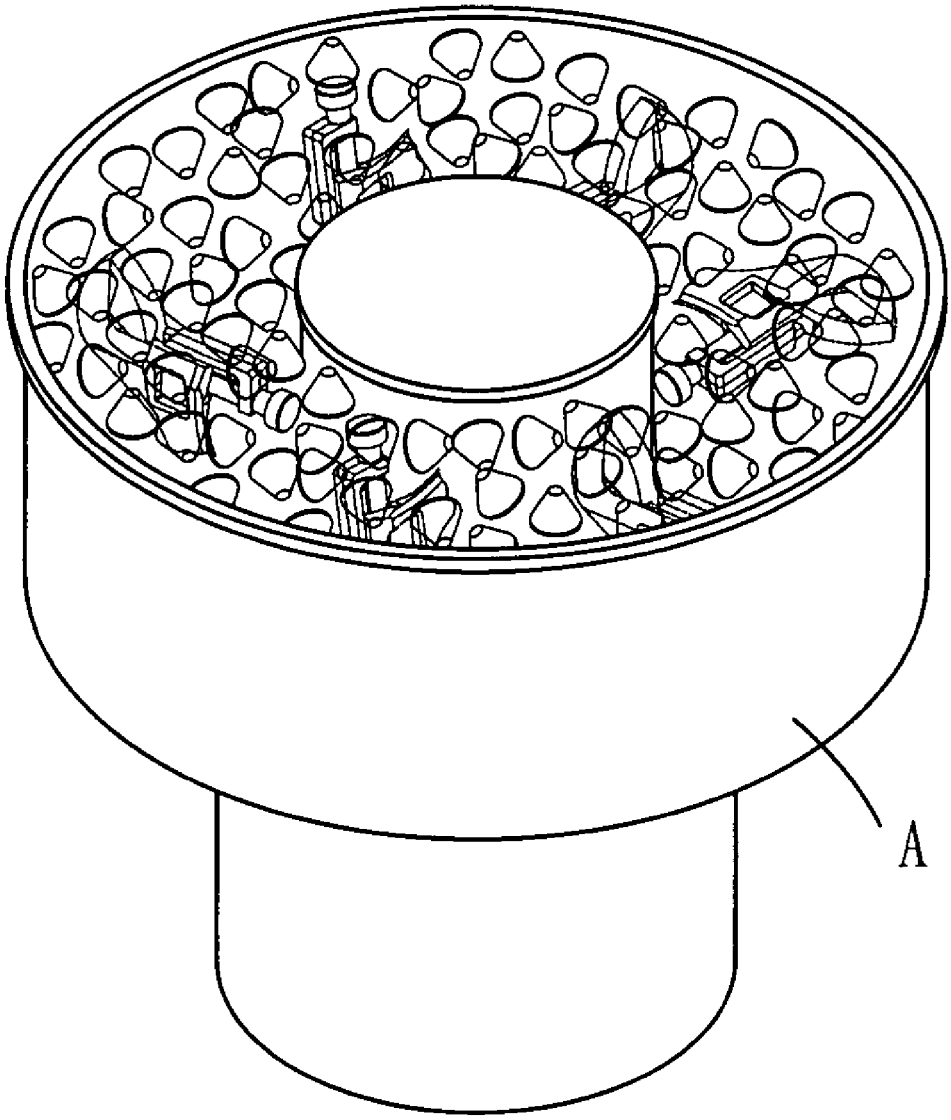
FIG. 8 shows that the adjustable wrench together with the positioning member are put in a barrel to be ground.
Figure 9:
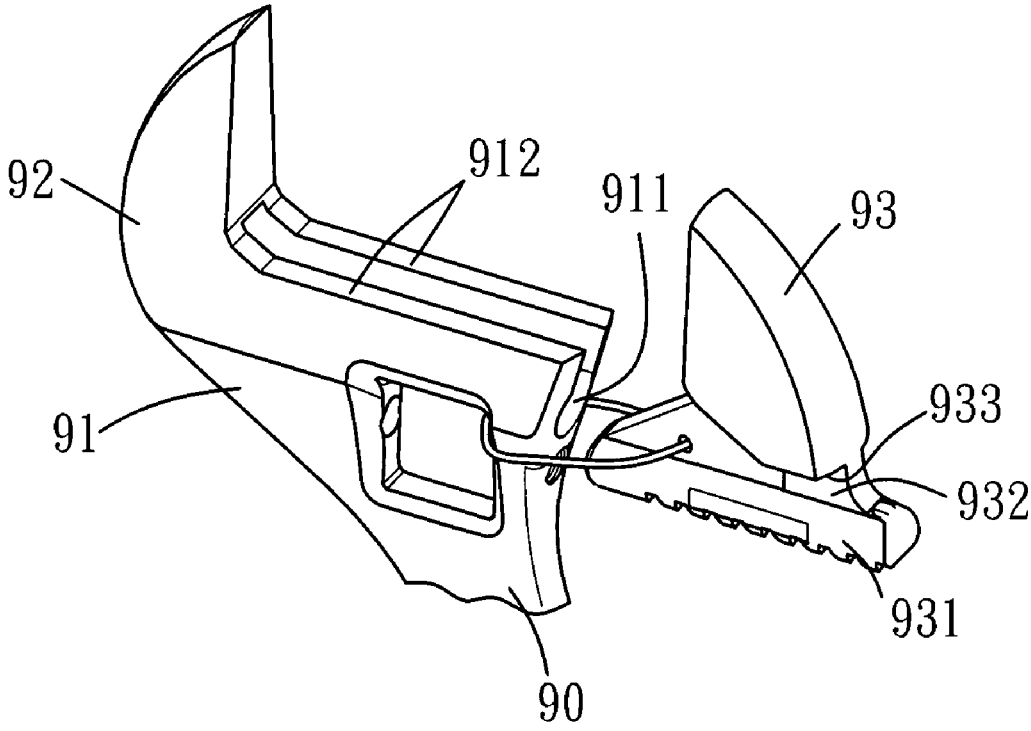
FIG. 9 Prior Art
FIG. 9 shows the movable jaw is tied to the head of the adjustable wrench when using a conventional surface grinding process.

The movable jaw 5 is slidably connected to the head 3 by sliding the rod 52 into the sliding groove 31, and a positioning member 10 is engaged with the sliding groove 31 to position the movable jaw 5. The combination of the adjustable wrench and the positioning member 10 are put into the barrel "A" as shown in FIG. 8 to be ground. The neck 54, the rod 52, the surface 55 that connects between underside of the jaw 51 and the neck 54, the two respective top surfaces of the sidewalls 33 and the sliding groove 31 are covered by the positioning member 10 and kept unground after the adjustable wrench is machined. The positioning member 10 is made of plastic, metal, rubber, polymer or stuffing material.

The positioning member 10 includes an elongate connection portion 11 which is wider than a width of the recess 32 and a covering portion 12 is located on the connection portion 11. An insertion 13 extends from an underside of the connection portion 11. The rod 52 of the movable jaw 5 is slid into the sliding groove 31 and contacts the clamping surface 41 of the fixed jaw 4. The insertion 13 of the positioning member 10 is inserted into the through hole 34 via the recess 32 by using a hammer and the connection portion 11 of the positioning member 10 is engaged with the recess 32 and the sliding groove 31 to position the movable jaw 5.

The front surface of the insertion 13 is in contact with the rear end of the rod 52. The covering portion 12 rests on and covers the two top surfaces of the sidewalls 33. The gap between the surface 55 and the two respective top surfaces of the sidewalls 33 are so small (usually between 0.05 mm to 0.25 mm) so that the abrasive chips cannot enter the gap so that the movable jaw 5 and the sliding groove 31 can be matched at a desired tolerance so that the movable jaw 5 does not shake during use.

Figure 5:
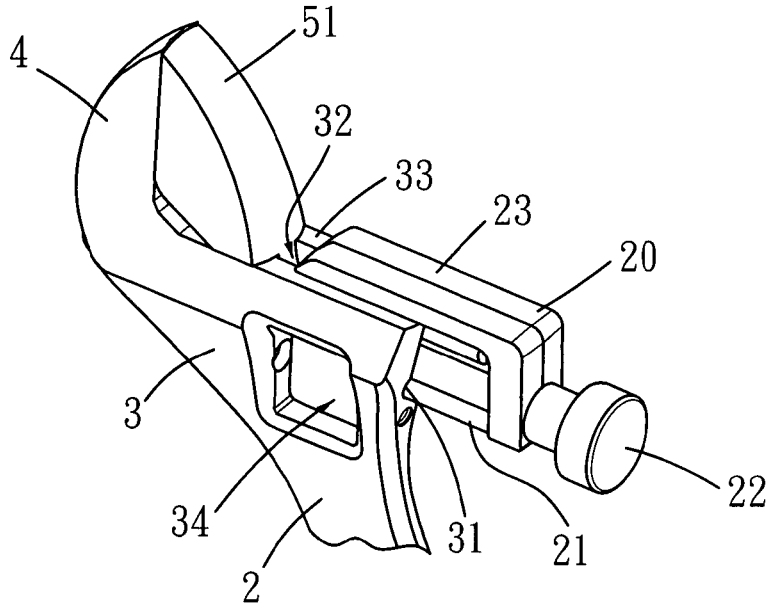
FIG. 5 is a perspective view to show a second embodiment of the positioning member of the present invention.

FIG. 5 shows a second embodiment of the positioning member 20 which includes a connection portion 21 which is slightly larger than the sliding groove 31 and an enlarged covering portion 23 is connected to the connection portion 21. A hammering surface 22 is connected to an end of the connection portion 21 so that the user may hammer at the hammering surface 22. An annular groove is defined between the hammering surface 22 and the connection portion 21 so that the user can holds the hammering surface 22 to pull the positioning member 20 out after grinding. An L-shaped covering portion 23 is located above the connection portion 21. The connection portion 21 of the positioning member 20 is engaged with the sliding groove 31 to position the movable jaw 5. The two respective top surfaces of the sidewalls 33 are covered by the covering portion 23. The distal end of the connection portion 21 contacts the rod 52 of the movable jaw 5 which does not shake during being ground.

Figure 6:
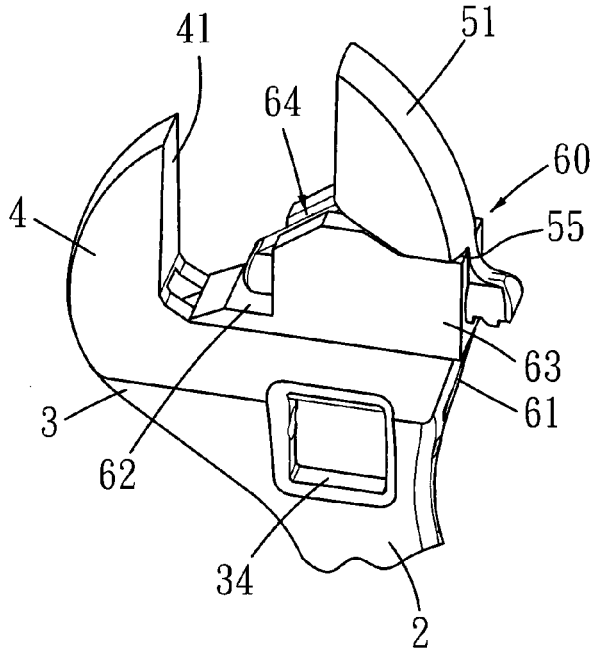
FIG. 6 is a perspective view to show a third embodiment of the positioning member of the present invention.

FIG. 6 shows a third embodiment of the positioning member 60 which includes a connection portion 61 which is wider than a width of the sliding groove 31 and a covering portion 62 is located on the connection portion 61. The covering portion 62 is larger than or equal to a width of the two sidewalls 33. Two walls 63 extend from the covering portion 62 so as to define a space 64 therebetween. The connection portion 61 is engaged with the sliding groove 31 and the covering portion 62 covers the two respective top surfaces of the sidewalls 33. The movable jaw 5 is inserted in the space 64 so that the movable jaw 5 is indirectly in contact with the fixed jaw 4. The rod 52, the neck 54, the surface 55 are covered and not ground. The outer surface 51 of the movable jaw 5 and the outer surface of the fixed jaw 4 and the clamping surface 41 are ground.

Figure 7:
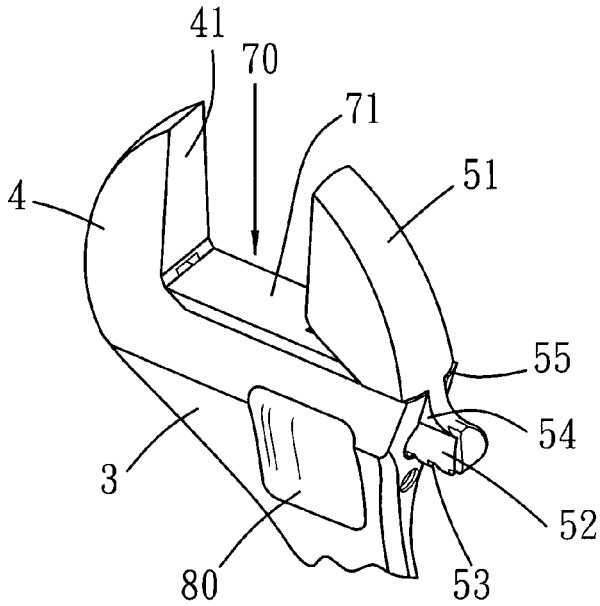
FIG. 7 is a perspective view to show a fourth embodiment of the positioning member of the present invention.

FIG. 7 shows a fourth embodiment of the positioning member which includes a first part 70 and a second part 80. The first part 70 includes a connection part which is larger than the recess 32 and an enlarged covering portion 71 which is connected on the connection portion and is wider than or equal to a width of two respective top surfaces of the sidewalls 33. The second part 80 is slightly larger than the through hole 34 and can be engaged with the through hole 34. The first part 70 is inserted into the recess 32 and positioned by the second part 80 which is engaged with the through hole 34 such that the movable jaw 5 is positioned at a distance from the fixed jaw 4. The enlarged covering portion 71 covers the two respective top surfaces of the sidewalls 33. The rod 52, the neck 54, the surface 55 are covered and not ground. The outer surface 51 of the movable jaw 5 and the outer surface of the fixed jaw 4 and the clamping surface 41 are ground.

While we have shown and described the embodiment in accordance with the present invention, it should be clear to those skilled in the art that further embodiments may be made without departing from the scope of the present invention.

What is claimed is:

1. A combination of a positioning member and an adjustable wrench, wherein the positioning member encloses a rod of a movable jaw of the adjustable wrench during surface grinding process;

wherein the positioning member includes a connection portion which is larger than a sliding groove and an enlarged covering portion is connected to the connection portion, the positioning member is engaged with the sliding groove to position the movable jaw.

2. The combination member as claimed in claim 1, wherein the movable jaw includes a jaw on a top thereof and the rod is connected to a bottom of the movable jaw, a neck is connected between the jaw and the rod.

3. A combination of a positioning member and an adjustable wrench, wherein the positioning member covers two respective top surfaces of two sidewalls of a fixed jaw of the adjustable wrench during surface grinding process;

wherein the adjustable wrench includes a handle and a head fixed to an end of the handle, the fixed jaw integrally extends from a side of the head and a sliding groove is defined in another side of the head, the two sidewalls extend from the head and define a recess therebetween which communicates with the sliding groove, the positioning member is engaged with the sliding groove or the recess so as to position the movable jaw, the positioning member includes a covering portion which covers two respective top surfaces of the two sidewalls.

4. A combination of a positioning member and an adjustable wrench, wherein the positioning member is engaged with a sliding groove of a head of the adjustable wrench to position a movable jaw to be in contact with a fixed jaw;

wherein the adjustable wrench includes a handle and the head fixed to an end of the handle, the fixed jaw integrally extends from a side of the head and the sliding groove is defined in another side of the head, the two sidewalls extend from the head and define a recess therebetween which communicates with the sliding groove, a through hole is defined through the head and communicates with the sliding groove, the movable jaw slidably engaged with the sliding groove, the positioning member is engaged with the sliding groove to position the movable jaw.

5. The combination as claimed in claim 4, wherein the positioning member includes a first part and a second pan, the first part includes a connection pan which is larger than the recess and an enlarged covering portion which is connected on the connection portion and is wider than or equal a width of two respective top surfaces of the sidewalls, the second part is larger than the recess, the first part is inserted into the recess and positioned by the second part which is engaged with the through hole such that the movable jaw is positioned at a distance from the fixed jaw.

6. The combination as claimed in claim 4, wherein the positioning member includes a connection portion which is wider than a width of the recess and a covering portion is located on the connection portion, an insertion extends from an underside of the connection portion, the insertion of the positioning member is inserted into the through hole and the connection portion of the positioning member is engaged with the recess to position the movable jaw which is located between the fixed jaw and the positioning member.

7. The combination as claimed in claim 4, wherein the positioning member is made of plastic, metal, rubber, polymer or stuffing material.

8. A combination of a positioning member and an adjustable wrench, wherein the positioning member is engaged with a sliding groove of a head of the adjustable wrench and a movable jaw is connected to the positioning member;

wherein the positioning member includes a connection portion which is wider than a width of the sliding groove and a covering portion is located on the connection portion, the covering portion is larger than or equal to a width of two sidewalls, two walls extend from the covering portion so as to define a space therebetween, the movable jaw is inserted in the space, the connection portion of the positioning member is engaged with the sliding groove so that the movable jaw is indirectly in contact with the fixed jaw.

9. The combination as claimed in claim 8, wherein the adjustable wrench includes a handle and the head fixed to an end of the handle, the fixed jaw integrally extends from a side of the head and a sliding groove is defined in another side of the head, the two sidewalls extend from the head and define a recess therebetween which communicates with the sliding groove, a through hole is defined through the head and communicates with the sliding groove.

10. The combination as claimed in claim 8, wherein the positioning member is made of plastic, metal, rubber, polymer or stuffing material.

11. An adjustable jaw with a mirror and smooth surface, comprising:

a handle and a head fixed to an end of the handle, the fixed jaw integrally extends from a side of the head and a sliding groove is defined in another side of the head, two sidewalls extend from the head and define a recess therebetween which communicates with the sliding groove, and a movable jaw including a jaw and a rod which is connected to an underside of the jaw, two respective top surfaces of the two sidewalls being kept unground after the adjustable jaw being machined;

wherein the movable jaw is directly or indirectly positioned in the sliding groove or the recess by a positioning member during surface grinding process, the positioning member covers two respective top surfaces of the sidewalls during the surface grinding process so that the two respective top surfaces of the sidewalls are kept unground after the adjustable jaw being machined.

* * * * *